US008882605B1

(12) United States Patent
Lee

(10) Patent No.: US 8,882,605 B1
(45) Date of Patent: Nov. 11, 2014

(54) GOLF TOOL KIT

(71) Applicant: Sun Young Lee, Fair Lawn, NJ (US)

(72) Inventor: Sun Young Lee, Fair Lawn, NJ (US)

( * ) Notice: Subject to any disclaimer, the term of this patent is extended or adjusted under 35 U.S.C. 154(b) by 0 days.

(21) Appl. No.: 14/321,393

(22) Filed: Jul. 1, 2014

(51) Int. Cl.
*A63B 57/00* (2006.01)
*A63B 47/04* (2006.01)

(52) U.S. Cl.
CPC ..... *A63B 57/0087* (2013.01); *A63B 57/0031* (2013.01); *A63B 57/0068* (2013.01); *A63B 57/0075* (2013.01); *A63B 47/04* (2013.01); *Y10S 224/918* (2013.01); *Y10S 224/9012* (2013.01)
USPC ..... 473/131; 473/408; 206/315.1; 224/918; 224/901.2; 15/209.1

(58) Field of Classification Search
USPC ..... 473/131, 406, 408, 282, 284, 285, 286; 206/315.1, 315.9; 224/269, 918, 901.2; 15/209.1, 210.1
See application file for complete search history.

(56) References Cited

U.S. PATENT DOCUMENTS 3,753,519 A * 8/1973 Gammon ..... 206/315.1
4,736,877 A * 4/1988 Clark ..... 206/315.1
5,022,650 A * 6/1991 Madock ..... 473/408
D330,140 S * 10/1992 Lerner ..... D6/608
5,450,954 A * 9/1995 Dunn ..... 473/131
5,517,696 A * 5/1996 Krugler ..... 224/918
D384,717 S * 10/1997 Hodges ..... D6/608
5,799,853 A * 9/1998 Brewster ..... 224/918
6,202,911 B1 * 3/2001 Freer ..... 224/918
6,220,973 B1 * 4/2001 Hsu ..... 473/408
7,152,279 B2 * 12/2006 Elliott ..... 24/3.1
8,573,457 B1 * 11/2013 Morgan ..... 224/918
2004/0149313 A1 * 8/2004 Dawson et al. ..... 473/408
2004/0211019 A1 * 10/2004 Hale ..... 15/209.1
2004/0255421 A1 * 12/2004 Kim ..... 15/209.1
2005/0262654 A1 * 12/2005 Cotton ..... 15/209.1
2007/0051768 A1 * 3/2007 Dobson et al. ..... 224/919
2008/0256734 A1 * 10/2008 Bratcher et al. ..... 15/209.1
2009/0151105 A1 * 6/2009 Bohannon et al. ..... 15/209.1
2009/0302083 A1 * 12/2009 Eisele ..... 224/269
2010/0193559 A1 * 8/2010 Van Huyssteen et al. .... 224/269
2010/0199451 A1 * 8/2010 Taylor ..... 15/210.1
2011/0108060 A1 * 5/2011 Kuk ..... 134/6

* cited by examiner

*Primary Examiner* — Steven Wong
(74) *Attorney, Agent, or Firm* — IPLA P.A.; James E. Bame

(57) ABSTRACT

A golf tool kit comprises a casing having a through hole, a reel fixed in the casing, a divot repair tool detachably attached to the casing, a ball marker magnetically attached to the divot tool, a belt clip rotatably attached to the casing opposing the divot repair tool, a flexible material retractably extending via the through hole from the reel, a holder having a hole, a first towel extending from the holder, and a second towel extending from the holder.

18 Claims, 5 Drawing Sheets

GOLF TOOL KIT

BACKGROUND

This invention relates to a golf accessory kit, and more particularly to a portable golf tool kit enabling a golfer to access required golf tools with easy and convenience.

A golf requires a variety of different accessories in addition to a basic gear including fourteen clubs and driver, golf balls and golf bags. Golf accessories for a typical golfer generally account for a glove, tees, a ball marker, a divot tool, a club cleaning brush, a towel, a club grip holder and so on. Some of them are kept in a golfer's pocket and taken out when needed in each hole, which tend to result in distraction and loss of concentration.

A couple of practice swings of a club or a driver are done then the club face needs to be cleaned; otherwise, even a grass debris remaining on the club face could change direction of the golf ball. Since a golf is an extremely sensitive sport so that any minor happenings could affect the swing and direction of the ball. Thus, a golfer needs to keep an eye on adequate use of golf accessories to obtain a best possible result.

A typical amateur or weekend golfer shows a common routine on the field and green. A golf course provides more par 4 holes than par 3 or par 5 holes so a par 4 hole will be taken as an example. A golfer first wears a glove and pick a club or a driver for a tee shot. A tee is taken out from among many different accessories in pockets. When a tee shot is completed, the tee is grabbed and placed back in a golfer's pocket to use for a subsequent tee shot. When the tee shot was done with an iron club, the club is wiped or washed to remove dirt or grass debris on the club face or in face grooves.

To improve the accuracy of a shot, a couple of practice shots are performed in a manner that the club bottom could lightly touch surface of a fairway or rough near the ball. The dirt or grass debris from the practice swings are removed from the club face or grooves prior to the second shot. Subsequent to the second shot, the club face is wiped or washed. In case the grooves in the club face carry dirt, mud or field debris, a portable brush or a tee is usually taken out from the golfer's pocket to scrub those alien stuff in the grooves after each shot.

Once the debris are removed from the club face, the brush or tee is put back into the golfer's pocket. When ready for a chip shot to land a ball on a green near the hole, a golfer usually repeats a couple of practice shots to improve chance to let the ball approach toward the hole. Following the practice swings, the golfer again removes alien material like dirt from the club face or head. When the chip shot is done, the club face or head is again wiped or washed to remove debris. When the grooves in the face need to be cleaned, a portable brush or tee is taken out again from the golfer's pocket to clean them. The brush or tee is then put back in the pocket. When the ball is mounted on the target hole green, the golfer takes out a glove and usually put it in a back pocket. Then, a ball marker is taken out from the pocket or a marker holder on a cap to mark the ball on the green. Right after grabbing the ball, it is cleaned or wiped out and put in a pocket and the player reads slope or breaks on the green. When a divot or a recess made by a ball hit is found on the route through which the ball is supposed to roll, then the player takes out a divot tool to flatten the divot area. When the divot area is raised to be flat enough, the dirt, sand or grass debris is wiped out from the divot tool. Thereafter, the divot tool is put back in a player's pocket and the ball is taken out from the pocket in a subsequent motion and placed ahead of the ball marker which is then grabbed and put back in the pocket.

In order to improve accuracy in putting, a couple of practice swings are done and the putter is cleaned or wiped to remove debris on the putter face if any. When putting is done, the ball is taken into the pocket to walk out of the green.

A golf player on average uses a towel eight times on each hole and this will amount to 144 times (8 on each hole times 18 holes) of towel being used to clean a ball or club. In addition, a golfer places his or her hand in the pocket 14 times to use accessories, which will amount to 252 times (14 on each hole times 18 holes). This means that instances using a towel and accessories will show the number of 396 per golf rounding. The number of repetition of such instances will be proportional to the golfer's score. That is, the higher the number of your handicap, the more instances of using the towel or other accessories. So an amateur or weekend golf player needs to use a towel at least 100 times and accessories at least 200 times per golf rounding.

A disadvantage of the conventional golf rounding with separate accessories is that a golfer does not appropriately use a towel in need. Instead, a bare hand, shoe sole or even part of pants is used to clean or wipe clubs or balls, thus resulting in unnecessarily frequent touch of a bare hand to contaminated grass debris with the least effect of cleaning the ball or the club face. The main reason for the golfer being reluctant to use a towel to clean a ball or club face seems to come from inconvenience in using an individual towel.

Another disadvantage is that weather and wind tend to cause the towel to get dried out way before the game ends though the towel needs to be kept wet up to the last hole to show a cleaning effect. Also, the golfer may have to suffer getting a shirt or a glove wet with the conventional independent towel though it is best to carry the towel on hand.

SUMMARY OF THE INVENTION

Accordingly, the present invention is contrived to overcome the conventional disadvantages.

An objective of this invention is to provide a wearable golf tool kit enabling a golfer to access main golf tools in a quick and convenient manner.

Another objective of this invention is to provide a portable golf tool kit with a built-in belt clip that can be clipped on a golfer's belt.

Still another of this invention is to provide a portable golf tool kit with a retractable reel enabling towels to get retractably engaged to a casing carrying a divot tool and ball marker.

A further objective of this invention is to provide a portable golf tool kit enabling a golfer to save time conventionally spent browsing main golf accessories during the game.

A still further objective of this invention is to provide a wearable all-in-one golf tool kit minimizing golf game delay resulting from individually using separated golf tools.

Further still another objective of this invention is to provide a portable golf tool kit with weather proof towels.

In order to achieve the above objectives, the present invention provides a golf tool kit, comprising: a casing having a through hole; a reel fixed in the casing; a divot repair tool detachably attached to the casing; a ball marker magnetically attached to the divot tool; a belt clip rotatably attached to the casing opposing the divot repair tool; a flexible material retractably extending via the through hole from the reel; a holder having a hole, wherein the flexible material is detachably attached to the holder by the hole; a first towel extending from the holder; a second towel extending from the holder, wherein the first and second towels are partially attached to each other to facilitate a golf ball being cleaned between the first and second towels.

In an embodiment, the first and second towels are sewn to each other along a curved line from top to bottom and seamed to each other along an edge of said each towel except a top edge part forming a top opening and a bottom edge part forming a bottom opening, wherein the top opening is larger than the bottom opening. A VELCRO is attached to an outer surface of the first towel to detachably hold a golf glove and the flexible material is formed of one selected from a plastic string, a fabric string and a metal string. A magnet is fixed to the casing, wherein the divot repair tool has a hole formed therethrough to enforce magnetic to the ball marker. A brush is detachably attached to an end of the divot repair tool to clean golf clubs. A linear pocket is formed on the first towel and a plurality of tee pockets below the linear pocket, wherein said each tee pocket accommodates a single tee. Further provided is a foldable club support having a center opening and being kept folded in the linear pocket when not used, and being unfolded and laid out with the center opening facing up on a golf green to safely hold a selected golf club being placed in the folded center opening of the club support.

Also provided is a foldable club support having a center opening and being kept folded in the linear pocket when not used, and being unfolded and laid out with the center opening facing up on a golf green to safely hold a selected golf club being placed in the folded center opening of the club support, wherein the club support maintains about 45 degrees between sides thereof when unfolded and laid out to support the selected golf club.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

Figure 1:
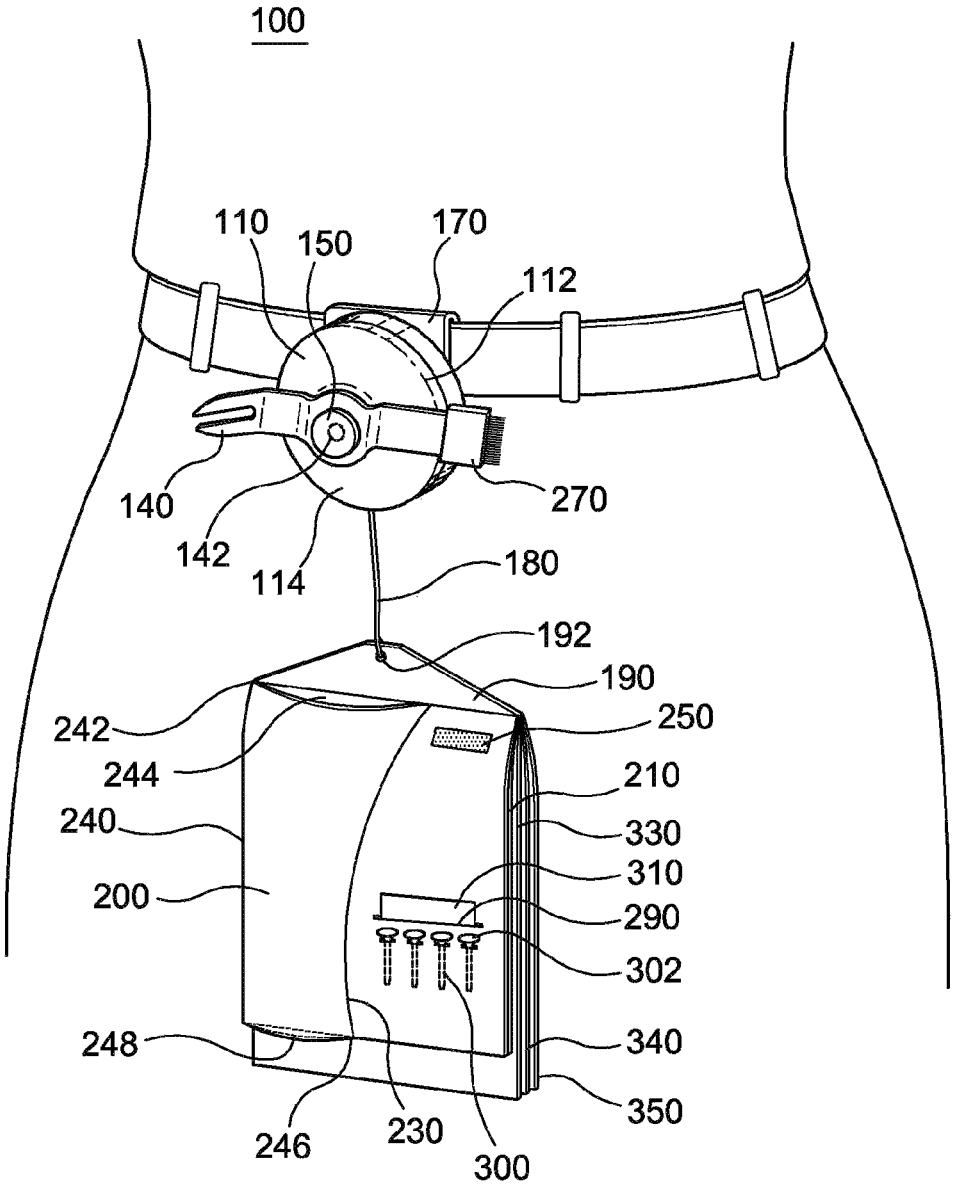
FIG. 1 is an exemplary view showing an overall arrangement of a golf tool kit according to the present invention.
Figure 2:
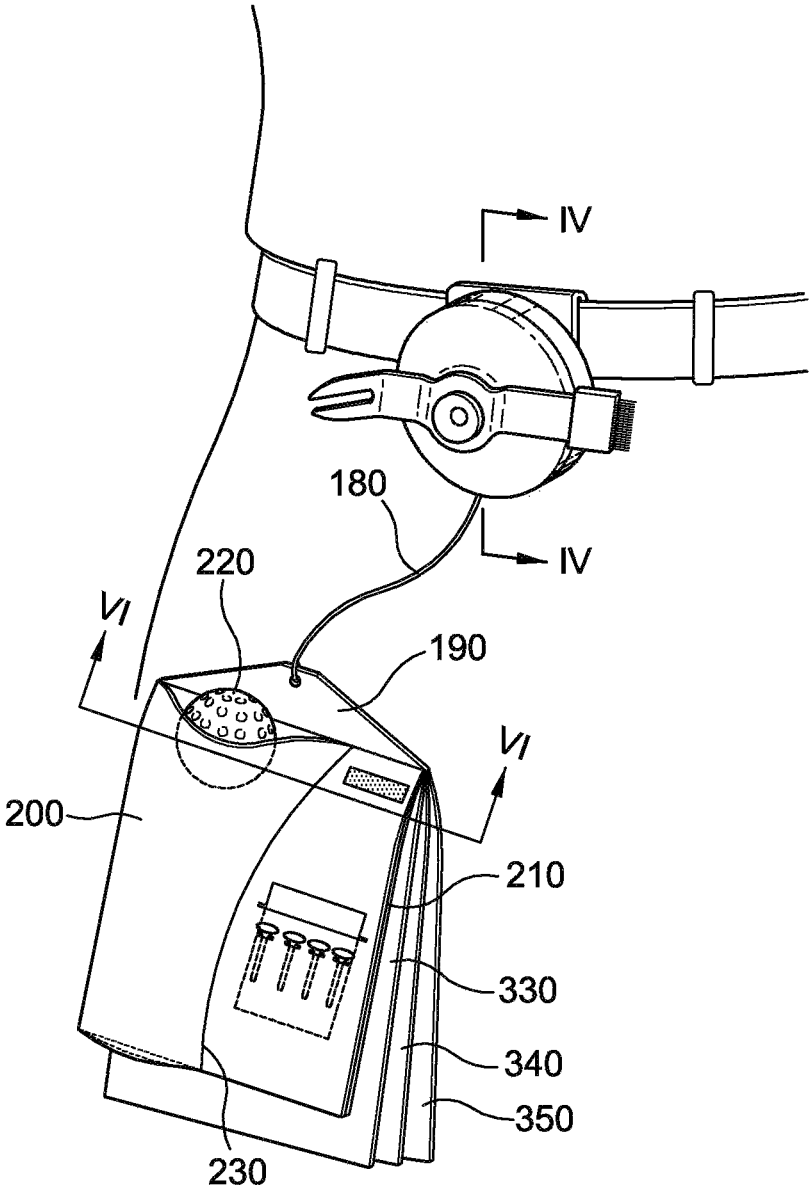
FIG. 2 is an another exemplary view showing a brief mechanism of the golf tool kit according to the present invention.
Figure 3:
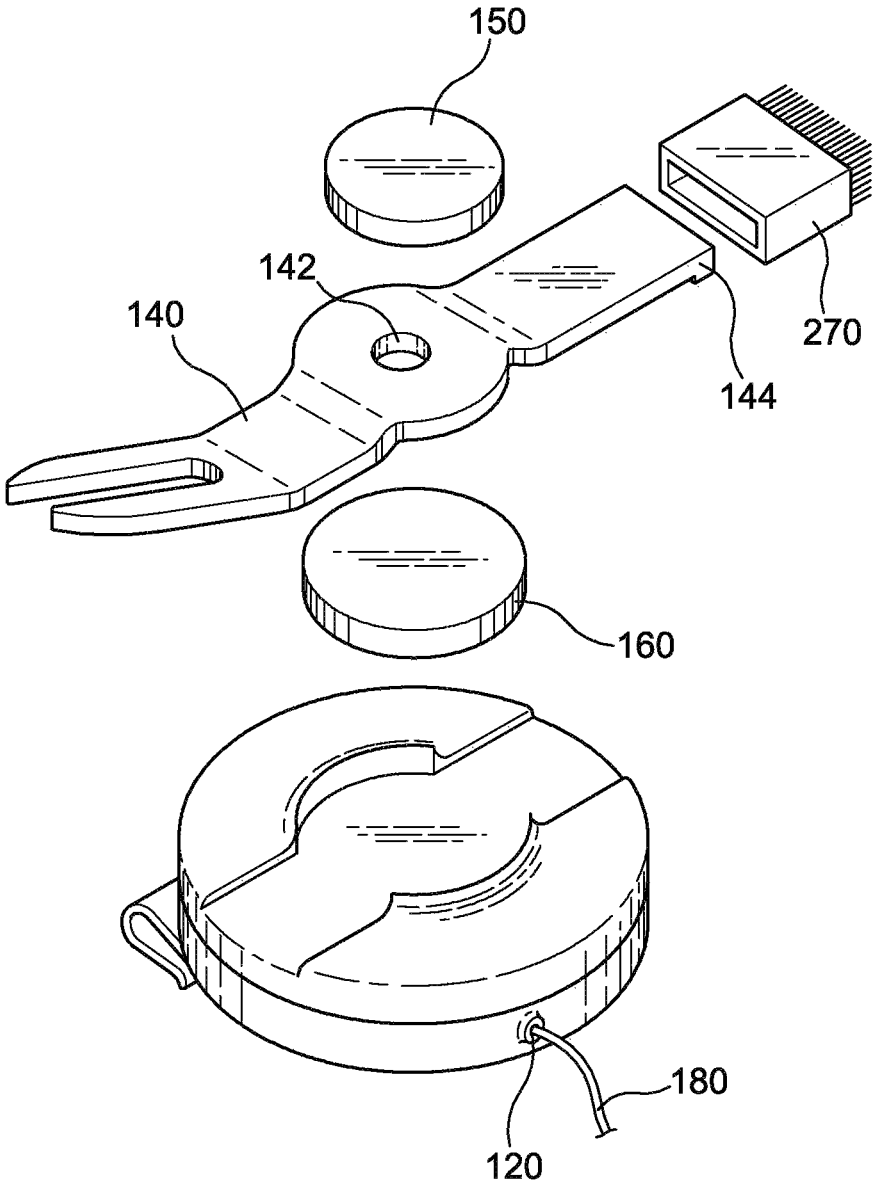
FIG. 3 is an exploded view showing construction of the golf tool kit other than towels.
Figure 4:
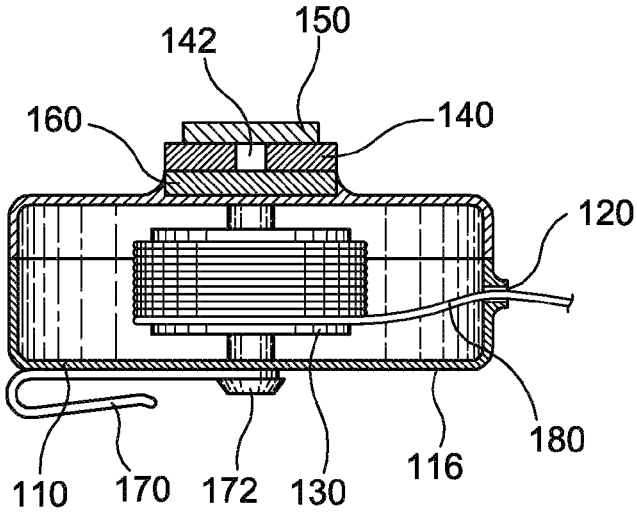
FIG. 4 is a cross-sectional view taken along IV-IV in FIG. 2.
Figure 5:
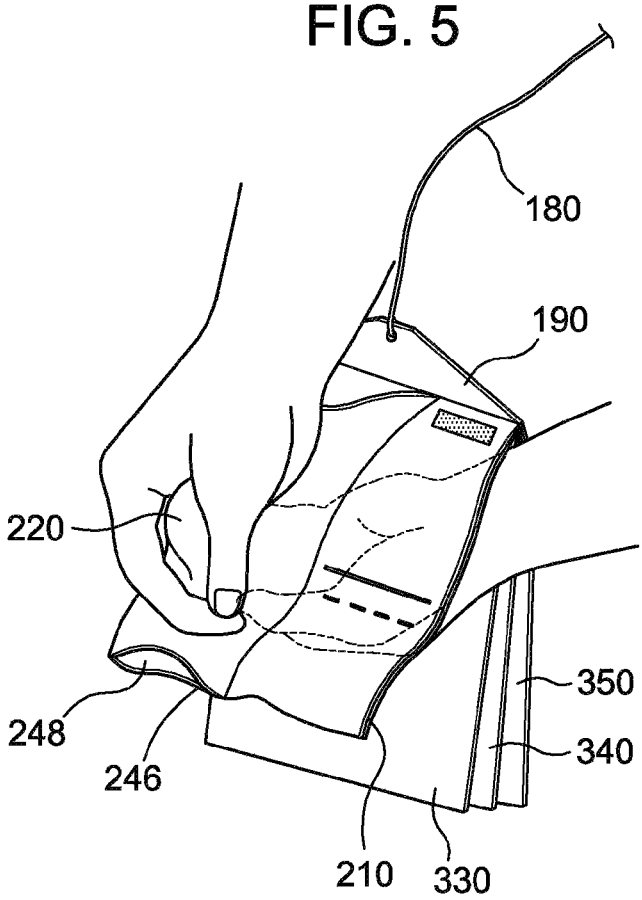
FIG. 5 is a view showing usage of towels according to the present invention.
Figure 6:
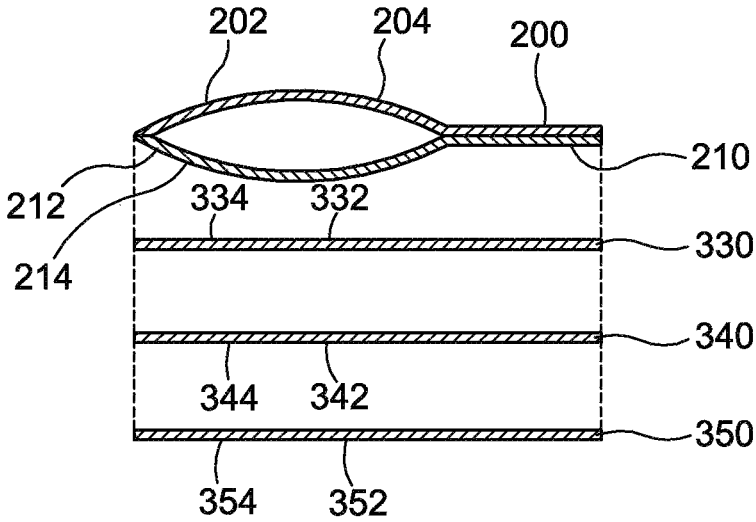
FIG. 6 is a cross-sectional view taken along VI-VI in FIG. 2.
Figure 7:
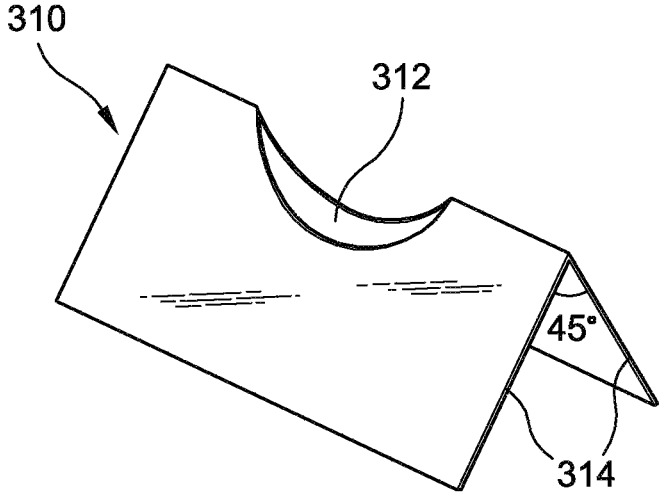
FIG. 7 is a perspective view of a club support laid out on the green according to the present invention.

Referring to the drawings, the present invention will now be explained. As shown in FIG. 1, the tool kit 100 includes a casing 110 having a through hole 120, a reel 130 fixed in the casing 110. The casing 110 may be formed circular, oval, or rectangular along its outer periphery 112 with their inner 114 and outer sides 116 substantially flattened depending upon the market trend and personal preference. The casing 110 is preferably made of one selected from a plastic material, a metallic board, and a synthetic fiber material. The through hole 120 is formed in and through the outer periphery 112. Inside the casing 110 is provided the reel 130.

In this construction, a divot repair tool 140 is detachably attached to the casing 110, and a ball marker 150 is magnetically attached to the divot tool 140. The detachable attachment of the divot repair tool 140 to the casing 110 is such that the divot tool 140 is magnetically attracted to the outer side 114 of the casing 110 when the detached divot tool 140 is approached by a user toward the outer side of the casing 110. In a preferred version, a magnet 160 is fixed to the casing 110 to facilitate the detachable attachment of the divot repair tool 140 to the casing 110. The divot repair tool 140 has a hole 142 formed therethrough to enforce magnetic to the ball marker 150.

In specific, when a golfer finishes putting on the green and puts back the marker where it was, the ball marker 150 is moved toward the golfer's waist with natural restoration of a hand grabbing the ball marker 150 and further attracted toward the divot repair tool 140 by the magnet 160 fixed to the outer side 114 of the casing 110. The hole 142 formed through the divot repair tool 140 serves to enforce the attraction of the approaching ball marker 150 toward the divot tool 140 while minimizing an inadvertent loss of the ball marker 150.

A belt clip 170 may be introduced and attached to the casing 110 opposing the divot repair tool 140. The belt clip 170 may be either permanently or detachably attached to the inner side 116 of the casing 110. As assumed in common sense, the belt clip 170 can be clipped or hooked in a golfer's belt. The golfer's belt serves to safely hold the tool kit 100 and the safe hold helps maintain reliable propping of the divot tool 140 to the casing 110. In a preferred version, the casing 110 may be rotatably engaged to the belt clip 170 so the golfer can rotate the casing 110 against the belt clip 170 to further facilitate usage of the golf tool kit 100. In this construction, a roller 172 may be provided between the belt clip 170 and the casing 110.

To improve usability, a flexible material 180 is substantially elongate and provided to retractably extend via the through hole 120 from the reel 130. The flexible material may be is formed of one selected from a plastic string, a fabric string and a metal string. The retractable characteristic of the substantially elongate flexible material 180 is such that a pull-release applies to accelerate the retraction and a pull-stop applies to extend the flexible material 180. In this mechanism, the pull-release and pull-stop of the flexible material 180 are enabled by the reel 130 preset with one end of the flexible material 180.

In order to further facilitate the usability of the tool kit 100, a holder 190 having a hole 192 is provided so that the flexible elongate material 180 can be detachably attached to the holder 190 by the hole 192. In this mechanism, further provided is a first towel 200 extending from the holder 190. Alternately, a second towel 210 is provided to further extend from the holder 190. In a preferred version, the first 200 and second 210 towels are partially attached to each other to facilitate a golf ball 220 being cleaned between the first 200 and second 210 towels. The first and second towels may be sewn to each other along a curved line 230 from top to bottom and seamed to each other along an edge of each towel except a top edge part 242 forming a top opening 244 and a bottom edge part 246 forming a bottom opening 248. Here, the top opening 244 is preferably formed larger than the bottom opening 248 so that the ball 220 being dried or cleaned up can be inserted into the top edge opening 244 in a relatively easy mode and released down along the curve line 230 in a relatively slow mode and taken out through the bottom edge opening 248 so as to facilitate a safe grab of the ball by the user.

A VELCRO 250 may be attached to an outer surface 202 of the first towel 200 to detachably hold a golf glove 260. In an alternate mode, a brush 270 may be detachably attached to an end 144 of the divot repair tool 140 to clean golf clubs. A linear pocket 290 may be further formed on the first towel 200 and a plurality of tee pockets 300 may be formed below the linear pocket 290 such that each tee pocket 300 could accommodate a single tee 302.

To maximize the usability of the golf tool kit 100, further provided is a foldable club support 310 having a center opening 312 and being kept folded in the linear pocket 290 when not used, and being unfolded and laid out with the center opening 312 facing up on a golf green to safely hold a selected golf club being placed in the folded center opening 312 of the club support 310.

In a preferred embodiment, the golf tool kit 100 may comprise: a casing 110 having a through hole 120; a reel 130 fixed in the casing 110; a divot repair tool 140 detachably attached to the casing 110; a ball marker 150 magnetically attached to the divot tool 140; a belt clip 170 attached to the casing 110 opposing the divot repair tool 140; a flexible material 180 retractably extending via the through hole 120 from the reel 130; a holder 190 having a hole 192, in which the flexible material 180 is detachably attached to the holder 190 by the hole 192; first 200 and second 210 towels each extending from the holder 190, where the first and second towels are partially attached to each other to facilitate a golf ball 220 being cleaned between the first and second towels, where each outer surface 202, 212 of the first 200 and second 210 towels is formed of a waterproof lining 204, 214 to keep longer each inner surface of the first and second towels in a damp status for a better ball cleaning.

A third towel 330 may be further provided to extend from the holder 190 and being placed behind the second towel 210 to facilitate a club head cleaning. Here, the third towel 330 has a waterproof lining 334 on a side 332 facing the second towel 210. A fourth towel 340 may be further provided to extend from the folder 190 to facilitate a club head cleaning. In this construction, the third 330 and fourth 340 towels may each have a waterproof lining on each outside surface.

Further, third to fifth towels 330, 340, 350 may be provided to each extend from the folder to facilitate a club head cleaning. Here, the third 330 and fourth 340 towels each have a waterproof lining 334, 344 on each outside surface 332, 342. In this mechanism, the fifth towel 350 has a waterproof lining 354 on an outside surface 352 to keep longer a damp status of the fifth towel 350.

For a better performance, the foldable club support 310 may be provided to maintain about 45 degrees between sides 314 thereof when unfolded and laid out to support the selected golf club.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A golf tool kit, comprising:

a casing having a through hole;

a reel fixed in the casing;

a divot repair tool detachably attached to the casing;

a ball marker magnetically attached to the divot tool;

a belt clip rotatably attached to the casing opposing the divot repair tool;

a flexible material retractably extending via the through hole from the reel;

a holder having a hole, wherein the flexible material is detachably attached to the holder by the hole;

a first towel extending from the holder;

a second towel extending from the holder, wherein the first and second towels are partially attached to each other to facilitate a golf ball being cleaned between the first and second towels; and a magnet fixed to the casing, wherein the divot repair tool has a hole formed therethrough to enforce magnetic attraction to the ball marker.

2. The golf ball kit of claim 1, wherein the first and second towels are sewn to each other along a curved line from top to bottom and seamed to each other along an edge of said each towel except a top edge part forming a top opening and a bottom edge part forming a bottom opening, wherein the top opening is larger than the bottom opening.

3. The golf ball kit of claim 1, further comprising a VELCRO fabric hook and loop fastener attached to an outer surface of the first towel to detachably hold a golf glove.

4. The golf ball kit of claim 1, wherein the flexible material is formed of one selected from a plastic string, a fabric string and a metal string.

5. The golf ball kit of claim 1, further comprising a brush detachably attached to an end of the divot repair tool to clean golf clubs.

6. The golf ball kit of claim 1, wherein a linear pocket is formed on the first towel and a plurality of tee pockets below the linear pocket, wherein said each tee pocket accommodates a single tee.

7. The golf ball kit of claim 6, further comprising a foldable club support having a center opening and being kept folded in the linear pocket when not used, and being unfolded and laid out with the center opening facing up on a golf green to safely hold a selected golf club being placed in the folded center opening of the club support.

8. A golf tool kit, comprising:

a casing having a through hole;

a reel fixed in the casing;

a divot repair tool detachably attached to the casing;

a ball marker magnetically attached to the divot tool;

a belt clip rotatably attached to the casing opposing the divot repair tool;

a flexible material retractably extending via the through hole from the reel;

a holder having a hole, wherein the flexible material is detachably attached to the holder by the hole;

first and second towels each extending from the holder, wherein the first and second towels are partially attached to each other to facilitate a golf ball being cleaned between the first and second towels, wherein each outer surface of the first and second towels is formed of a waterproof lining to keep longer each inner surface of the first and second towels in a damp status for a better ball cleaning; and a magnet fixed to the casing, wherein the divot repair tool has a hole formed therethrough to enforce magnetic attraction to the ball marker.

9. The golf ball kit of claim 8, further comprising a third towel extending from the holder and being placed behind the second towel to facilitate a club head cleaning, wherein the third towel has a waterproof lining on a side facing the second towel.

10. The golf ball kit of claim 8, further comprising third and fourth towels each extending from the folder to facilitate a club head cleaning, wherein the third and fourth towels each have a waterproof lining on each outside surface.

11. The golf ball kit of claim 8, further comprising third to fifth towels each extending from the folder to facilitate a club head cleaning, wherein the third and fourth towels each have a waterproof lining on each outside surface, wherein the fifth towel has a waterproof lining on an outside surface to keep longer a damp status of the fifth towel.

12. The golf ball kit of claim 8, wherein the first and second towels are sewn to each other along a curved line from top to bottom and seamed to each other along an edge of said each towel except a top edge part forming a top opening and a bottom edge part forming a bottom opening, wherein the top opening is larger than the bottom opening.

13. The golf ball kit of claim 8, further comprising a fabric hook and loop fastener attached to an outer surface of the first towel to detachably hold a golf glove.

14. The golf ball kit of claim 8, wherein the flexible material is formed of one selected from a plastic string, a fabric string and a metal string.

15. The golf ball kit of claim 8, further comprising a brush detachably attached to an end of the divot repair tool to clean golf clubs.

16. The golf ball kit of claim 8, wherein a linear pocket is formed on the first towel and a plurality of tee pockets below the linear pocket, wherein said each tee pocket accommodates a single tee.

17. The golf ball kit of claim 16, further comprising a foldable club support having a center opening and being kept folded in the linear pocket when not used, and being unfolded and laid out with the center opening facing up on a golf green to safely hold a selected golf club being placed in the folded center opening of the club support.

18. A golf tool kit, comprising:

a casing having a through hole;

a reel fixed in the casing;

a divot repair tool detachably attached to the casing;

a ball marker magnetically attached to the divot tool;

a belt clip rotatably attached to the casing opposing the divot repair tool;

a flexible material retractably extending via the through hole from the reel;

a holder having a hole, wherein the flexible material is detachably attached to the holder by the hole;

first and second towels each extending from the holder, wherein the first and second towels are partially attached to each other to facilitate a golf ball being cleaned between the first and second towels, wherein each outer surface of the first and second towels is formed of a waterproof lining to keep longer each inner surface of the first and second towels in a damp status for a better ball cleaning, wherein a linear pocket is formed on the first towel and a plurality of tee pockets below the linear pocket, wherein said each tee pocket accommodates a single tee, wherein a foldable club support having a center opening and being kept folded in the linear pocket when not used, and being unfolded and laid out with the center opening facing up on a golf green to safely hold a selected golf club being placed in the folded center opening of the club support, wherein the club support maintains about 45 degrees between sides thereof when unfolded and laid out to support the selected golf club.

* * * * *